US005794284A

United States Patent [19]

Southwell, Jr. et al.

[11] Patent Number: 5,794,284

[45] Date of Patent: Aug. 18, 1998

[54] APPARATUS FOR AIDING PERSONS IN RISING FROM A SEATED POSITION TO A STANDING POSITION

[75] Inventors: Joseph Ray Southwell, Jr.; Deborah Ann Southwell; Ruth Ann Southwell; Joseph Ray Southwell, III; Kathryn A. Sikorski; Paul Robinson; James Edward Petkovsek; Steven Bereyso, all of McKinney, Tex.

[73] Assignee: Walker Sled, L.P., McKinney, Tex.

[21] Appl. No.: 689,739

[22] Filed: Aug. 13, 1996

[51] Int. Cl.[6] ..... A61H 3/00

[52] U.S. Cl. ..... 5/81.1 R; 5/662; 135/67; 297/DIG. 10

[58] Field of Search ..... 5/81.1 R, 662; 135/65, 66, 67; 297/DIG. 10; 280/15, 18, 19, 24, 28.17

[56] References Cited

U.S. PATENT DOCUMENTS

| | | | |
|---|---|---|---|
| 357,132 | 2/1887 | Putnam, Jr. | 280/18 |
| D. 365,314 | 12/1995 | Heisinger | D12/130 |
| 740,603 | 10/1903 | Storms | 280/15 |
| 2,468,470 | 4/1949 | Spieth | 280/24 |
| 2,757,388 | 8/1956 | Chisholm | 5/317 |
| 2,792,052 | 5/1957 | Johannesen . | |
| 3,041,636 | 7/1962 | Twedt | 5/81 |
| 3,085,258 | 4/1963 | Wolferts | 5/92 |
| 3,157,593 | 11/1964 | Watson | 209/219 |
| 3,272,530 | 9/1966 | Klassen | 280/79.2 |
| 3,374,003 | 3/1968 | Fulsom | 280/18 |
| 3,378,274 | 4/1968 | Poppen | 280/18 |
| 3,421,529 | 1/1969 | Vestal | 135/45 |
| 3,553,746 | 1/1971 | Seiger | 5/317 |
| 3,591,874 | 7/1971 | O'Kennedy | 5/81 |
| 3,668,723 | 6/1972 | Bratton | 5/327 |
| 3,690,691 | 9/1972 | Kampe | 280/24 |
| 3,739,793 | 6/1973 | Wilson | 135/45 |
| 3,993,349 | 11/1976 | Neufeld et al. | 297/6 |
| 4,314,576 | 2/1982 | McGee | 135/67 |
| 4,474,202 | 10/1984 | Blechner | 135/67 |
| 4,843,661 | 7/1989 | Skibinski | 5/81 |
| 4,844,107 | 7/1989 | Watkins | 135/65 |
| 4,922,560 | 5/1990 | Skibinski | 5/81 |
| 5,295,498 | 3/1994 | Van Meter et al. | 135/65 |
| 5,305,773 | 4/1994 | Browning | 135/67 |

*Primary Examiner*—Steven N. Meyers
*Assistant Examiner*—Robert G. Santos
*Attorney, Agent, or Firm*—Konneker & Smith, P.C.

[57] ABSTRACT

Apparatus for aiding persons in rising or descending between seated and standing positions provides stability to a conventional walker. In a preferred embodiment, an apparatus has a platform portion and two flexible connection members. The platform portion is substantially rigid and includes two parallel rails. At forward end portions of the rails, openings are formed for pivotable attachment therethrough of the connection members. The connection members are also pivotably attached to a forward portion of the walker, so that when a person places his or her weight on the platform portion, the connection members transmit the weight to the walker, thereby stabilizing the walker.

7 Claims, 3 Drawing Sheets

APPARATUS FOR AIDING PERSONS IN RISING FROM A SEATED POSITION TO A STANDING POSITION

BACKGROUND OF THE INVENTION

The present invention relates generally to apparatus for aiding infirm persons and, in a preferred embodiment thereof, more particularly provides a walker device which is operative to assist persons as they rise from a seated position to a standing position.

Many persons have difficulty rising from a seated position, because of an infirmity due to illness, advanced age, or other debilitation. This becomes of special concern when chairs, couches and bed are used, as an individual may be deeply seated in the cushioning, aggravating any difficulty in getting up.

Devices for assisting persons rising from a seated position are generally of three types. One type utilizes a mechanism within the seat and actually lifts up as the person rises from a seated position, thereby assisting him or her in standing. These devices are expensive and only help people when they sit in those particular pieces of furniture that include the lifting mechanism.

A second type, such as those disclosed in U.S. Pat. Nos. 4,843,661 and 4,922,560, the disclosures of which are hereby incorporated by reference, include a handle which permits a seated person to grab the handle and pull on it while rising. These devices have the advantage that they are not necessarily connected to any particular piece of furniture, and so may be employed wherever the individual may be seated. These devices are somewhat encumbering and must be transported from seat to seat, which may be a laborious task for a person who must hold onto a walker for support during walking.

A third type, such as that disclosed in U.S. Pat. No. 4,474,202, the disclosure of which is hereby incorporated by reference, is a walker device which includes a duality of hand grips and a mechanism somewhat similar to skis on both sets of legs located at the floor level which is secured to legs of the walker for applying foot pressure to a frame of the walker as the person rises from a sitting position to a standing position. This device has the advantage of being transportable, e.g., it is permanently attached to the walker. However, a user is faced with stability problems when the walker is used on uneven surfaces. Additionally, in order for the device to work effectively the walker must be pulled close enough to the user so that the walker frame encompasses approximately the front seventy-five percent of a chair. This again limits the user of the device to specific chairs or other furniture.

Other assist devices, such as those shown and described in U.S. Pat. Nos. 3,041,636, 3,272,530, and 4,157,593, the disclosures of which are hereby incorporated by reference, are rather complicated and are more particularly directed to infirm persons who are generally non-ambulatory, in that a retaining structure is provided to prevent the user from falling out of the device and wheels are provided for locomotion.

A typical conventional walker is comprised of a frame including a plurality of generally upright legs and handrails. One type of conventional walker is made from lightweight aluminum tubing. The legs of the walker may be telescopic to enable the height to be adjusted and the walker may be collapsible to provide for its storage.

Many disabled or infirm persons find it quite difficult to rise from a sitting position to a standing position utilizing a conventional walker. When an infirm person attempts to use a conventional walker, the person typically must grasp the handrails and attempt to raise him- or herself to the standing position. As the person pulls on the handrails a conventional walker tends to pivot about the lower end portion of its rear legs, thus making it very difficult for the person to rise and, in some instances, this instability may result in a person falling and being injured.

The problem of the instability of a conventional walker when a person attempts to rise from a sitting position to a standing position is described in U.S. Pat. No. 3,085,258, the disclosure of which is hereby incorporated by reference. This patent discloses the use of a holder that is rigidly attached to a bed or other object which holds the walker in place as the person rises to the standing position. Although the holder disclosed in this patent appears to function adequately, the holder is only suitable for a specific piece of furniture to which it is attached.

Another approach to aids for persons rising from a sitting position to a standing position is disclosed in U.S. Pat. No. 3,739,793, the disclosure of which is hereby incorporated by reference. This patent discloses a device that has relatively long lower legs which are in contact with the floor and which are said to provide stability to the device when a person attempts to rise from the sitting position. Yet another device for aiding a person in rising from a sitting position to a standing position is disclosed in U.S. Pat. No. 3,668,723, the disclosure of which is hereby incorporated by reference.

It is a principal object of the present invention to provide apparatus for assisting seated persons in rising to a standing position, which apparatus is in the form of a portable, inexpensive, simple, and convenient device. It is an additional object of the present invention to provide an assist for a seated person to aid in helping the person rise, while maintaining stability on unlevel ground and not obstructing the person's pathway.

Another object of the present invention is to provide apparatus for seated persons so that they may more easily rise, which apparatus may be utilized conveniently with any type of seating, such as various chairs, sofas, beds, or other structures on which the persons may sit. It is yet another object of the present invention to provide an assist to a person rising from a seated position which includes a portion operative to stabilize it against pitching upward when the person pulls on it.

It is still a further object of the present invention to provide a walker device that assists a person in rising from a sitting position to a standing position. It is a further object of the present invention to provide a simply operated and lightweight device achieving the aforementioned objectives. It is a further object of the present invention to provide a mechanism which may be used to modify a conventional walker without requiring extensive changes to the conventional walker, the modified walker achieving the aforementioned objectives. Other objects and advantages of apparatus constructed in accordance with the present invention will become apparent from consideration of the following description.

SUMMARY OF THE INVENTION

In a preferred embodiment disclosed hereinbelow, apparatus constructed in accordance with principles of the present invention is comprised of a durable lightweight platform having a generally flat surface on each of two sides for enabling stable placement of a person's foot thereon, and a flexible connecting member, such as rope, chain, or strapping. The platform may contain a hook or curved end for hanging the invention on a walker. The platform may have non-skid or non-slip surfaces.

The invention may be used in at least two manners. In a first manner, a user places the platform, which is secured to the walker, on the floor perpendicular to a seat or structure on which the user is sitting. The user then grabs the walker's frame or handles, places his or her feet on the platform, and then applies foot pressure to the platform. The user pulls forward and upwardly on the frame or handles as needed to rising to a standing position. As the user exerts arm force to lift his or her body, the walker frame is securely held in place by the foot pressure on the platform, which thereby holds the front of the walker in place.

In a second manner of using the apparatus, the user places the platform on the floor and pulls the walker back toward him or her by pivoting the walker on its back legs and thus pivoting the platform on its back edge. The user then places his or her feet near the front of the platform, holds the walker securely near him- or herself and shifts his or her weight forward onto the platform. The platform changes a direction of a force created by the shifted weight and pulls the user to a standing position.

After rising to a standing position, the user may step off of the platform, reattach the platform to the walker, and then walk away from whatever piece of furniture on which he or she was seated, taking the walker and platform with him or her.

The user may also use the apparatus to assist in lowering him- or herself from a standing to a seated position by simply reversing the above manners of rising.

It should be understood that a typical walker tends to pivot about its rear legs when a person applies arm force to the upper part of the walker frame in an attempt to rise. An apparatus constructed in accordance with the principles of the present invention is advantageous in that it is easily adaptable to virtually any walker. Thus, the mobility of the user who would normally require assistance of another person to rise from a sitting position is increased by use of the apparatus.

DETAILED DESCRIPTION

Figure 1:
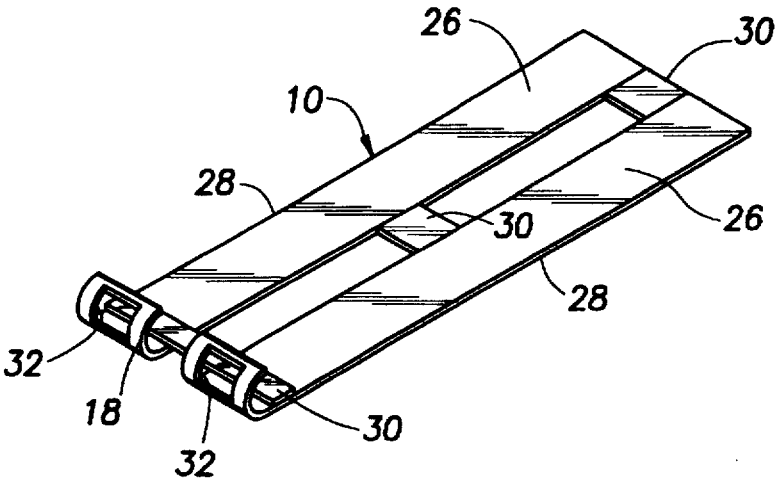
FIG. 1 is a perspective view of a platform portion of apparatus embodying principles of the present invention.
Figure 2:
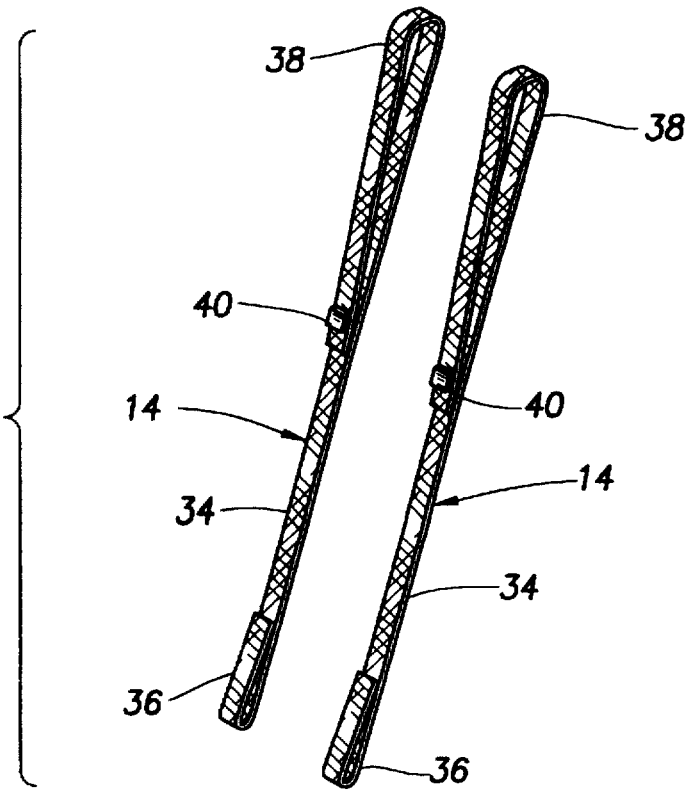
FIG. 2 is a perspective view of flexible connection members of the apparatus.
Figure 3:
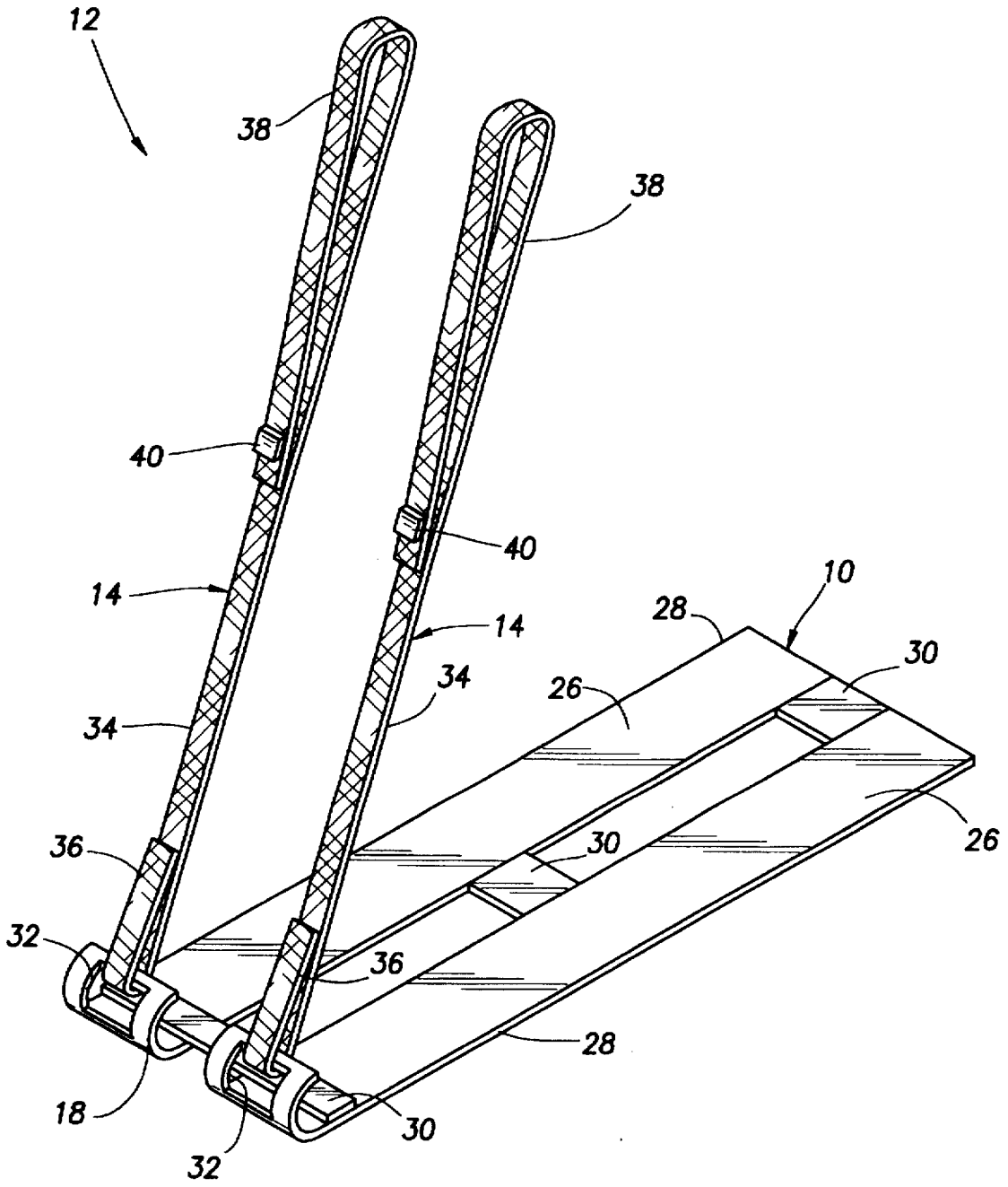
FIG. 3 is a perspective view of the apparatus wherein the platform portion and the connection members are operatively joined.
Figure 4:
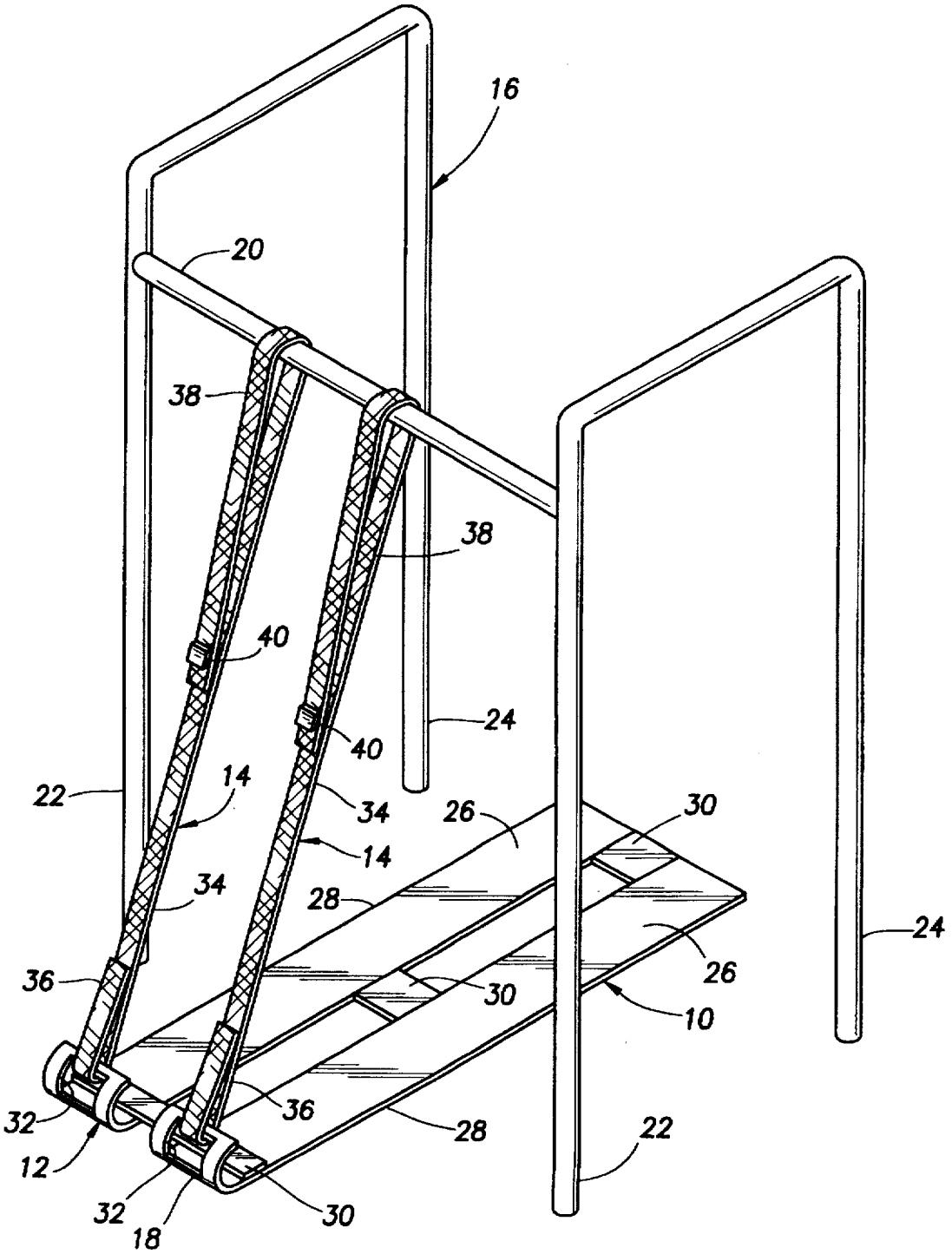
FIG. 4 is a perspective view of the apparatus operatively attached to a walker.

Representatively illustrated in FIGS. 1–4 is an apparatus 12 (see FIG. 3) embodying principles of the present invention. A platform portion 10 of the apparatus 12 is substantially rigid and flexible connection members 14 are provided for operative connection of the platform portion to a conventional walker 16 (see FIG. 4). The connection of the apparatus 12 to the walker 16 is between a forward end 18 of the platform 10 and a front lateral rail 20 of the walker.

The platform 10 is greater in length than a distance from front legs 22 of the walker 16 to back legs 24 of the walker and is provided with non-skid or non-slip upper side surfaces 26. The rigid platform 10, when placed flat on the ground, is extendable beyond the front legs 22 of the walker 16.

The connection members 14 are flexible and may be made of rope, chain, strapping, or other material. The connection members 14 are substantially taut when the apparatus 12 is being used by a person rising from a seated position or descending from a standing position.

As representatively illustrated, the apparatus 12 includes the rigid platform 10 comprised of two metal rails 28 which curve upward at the front end 18 of the platform. Laterally extending bars 30 join the rails 28 in a parallel spaced apart relationship to each other. An opening 32 is formed through each rail 28 near the forward upturned end 18 of the platform 10. The entire platform 10 may be dipped in a non-slip plastic coating to form the non-skid surfaces 26 and otherwise provide non-skid areas on the platform.

It is to be understood that other materials may be utilized in forming the platform 10 without departing from the principles of the present invention. For example, the platform 10 may be made of a single integrally-formed member which has the forward upturned end 18 formed thereon. As another example, the platform 10 may be any elongated rigid member, such as a pipe. Applicants, however, prefer the laterally spaced apart rails 28, so that wind may pass therebetween.

The connection members 14 are each comprised of a woven strap 34. Each strap 34 is attached to one of the two rails 28, the straps being looped through the openings 32 on the front end 18 of the platform 10. Each strap 34 is then sewn to itself to form a loop 36. In use, opposite ends 38 of the straps 34 are looped over the front rail 20 of the walker 16. Each of the opposite ends 38 is secured about the rail 20 with a buckle 40, similar to a belt. The buckles 40 permit the connection members 14 to be adjusted to various sizes and styles of walkers 16. However, it is to be understood that other fastening devices, such as clasps, etc., may be provided without departing from the principles of the present invention.

The connection between the platform 10 and the walker 16, and the weight of a person on the platform being applied to the front of the walker allows the walker to be held steady while the person pulls him- or herself from a sitting to a standing position.

The apparatus 12 may also be otherwise connected to the walker 16. For example, a hooked end or hanging device may be provided which allows the platform 10 to hang from the walker 16 while the person is using the walker to walk from one place to another. The platform 10 may also be foldable, thereby permitting the platform to be hung on the walker 16 near the platform's midsection.

The foregoing detailed description is to be clearly understood as being given by way of illustration and example only, the spirit and scope of the present invention being limited solely by the appended claims.

What is claimed is:

1. Apparatus for aiding a person in rising from a seated position, the apparatus comprising:

a walker:

a substantially rigid platform portion, said platform portion including first and second elongated rails and a plurality of lateral bars coupled to said first and second rails, said bars maintaining said first and second rails in a parallel spaced apart relationship to each other, and said platform portion further including a forward end portion and first and second openings formed through said forward end portion; and first and second substantially flexible elongated connection members, each of said first and second connection members having first and second opposite end portions, each of said first and second connection members being pivotably attached through one of said first and second openings at said first opposite end portion thereof, and each of said first and second connection members being pivotably attached to the walker at said second opposite end portion thereof.

2. The apparatus according to claim 1, wherein said second opposite end portion of each of said first and second connection members is adjustable to vary an operative length of each of said first and second connection members, whereby said platform portion is positionable flat on a floor on which the walker is operatively disposed.

3. The apparatus according to claim 1, wherein said platform portion further includes an upper side surface, said upper side surface being treated to prevent sliding thereon.

4. The apparatus according to claim 1, wherein said platform portion is forwardly extendable relative to the walker while said first and second connection members are operatively attached to the walker.

5. The apparatus according to claim 1, wherein each of said first and second connection members is attached to a front lateral rail of the walker.

6. Stabilizing apparatus for use while a person having weight rises from a seated position and descends from a standing position, the apparatus comprising:

a walker;

means for supporting a portion of the person's weight, said supporting means being disposable beneath the person, and supporting means comprising a substantially rigid platform portion, said platform portion including first and second elongated rails and a plurality of lateral bars coupled to said first and second rails, said bars maintaining said first and second rails in a parallel spaced apart relationship to each other, and said platform portion further including a forward end portion and first and second openings formed through said forward end portion; and means for transmitting said portion of the person's weight from said supporting means to the walker, whereby said portion of the person's weight is supported by said supporting means and is transmitted to the walker by said transmitting means when the person is rising and when the person is descending.

7. The apparatus according to claim 6, wherein said transmitting means comprises first and second substantially flexible elongated connection members, each of said first and second connection members having first and second opposite end portions, each of said first and second connection members being pivotably attached through one of said first and second openings at said first opposite end portion thereof, and each of said first and second connection members being pivotably attached to the walker at said second opposite end portion thereof.

* * * * *